US006811099B2

(12) United States Patent
Krestine et al.

(10) Patent No.: US 6,811,099 B2
(45) Date of Patent: Nov. 2, 2004

(54) BATTERY PACK FOR BATTERY OPERATED SPRAYER

(75) Inventors: Joseph R. Krestine, Leawood, KS (US); David DeJonge, West Olive, MI (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 20 days.

(21) Appl. No.: 10/300,765

(22) Filed: Nov. 21, 2002

(65) Prior Publication Data

US 2004/0099751 A1 May 27, 2004

(51) Int. Cl.[7] ..... A62C 13/62; A62C 13/66; A62C 35/58; B05B 9/03

(52) U.S. Cl. ..... 239/524; 239/525; 239/526; 222/333

(58) Field of Search ..... 239/524–527, 239/360, 263.1, 289, 333, 337, DIG. 14, 302; 222/333, 128; 294/903, 149

(56) References Cited

U.S. PATENT DOCUMENTS

| | | | | |
|---|---|---|---|---|
| 3,173,584 A | | 3/1965 | Giavasis | 222/263 |
| 3,993,250 A | | 11/1976 | Shure | 239/332 |
| 4,162,037 A | | 7/1979 | Koyama | 239/332 |
| 4,750,641 A | | 6/1988 | Chin-Fu | 222/79 |
| 5,150,841 A | | 9/1992 | Silvenis et al. | 239/332 |
| 5,397,034 A | | 3/1995 | Wunsch | 222/333 |
| 5,613,773 A | * | 3/1997 | Scott et al. | 366/163.2 |
| 5,716,007 A | | 2/1998 | Nottingham et al. | 239/332 |
| 5,762,239 A | | 6/1998 | Cossette | 222/236 |
| 6,116,520 A | * | 9/2000 | Lee | 239/289 |
| 6,123,235 A | | 9/2000 | Hsu | 222/327 |
| 6,152,333 A | | 11/2000 | Binder | 222/333 |

OTHER PUBLICATIONS

U.S. pat. appln. Publ. No. 2002/0011531, DiMaggio et al., Liquid Dispenser, Jul. 31, 2001.

* cited by examiner

*Primary Examiner*—Thomas Denion
*Assistant Examiner*—Jaime Corrigan
(74) *Attorney, Agent, or Firm*—Dykema Gossett PLLC

(57) ABSTRACT

A battery operated sprayer has an elongated handle for gripping by the operator for actuating the sprayer and for supporting the container to which the sprayer is attached, a removable battery pack forms a removable portion of the handle which solely supports a plurality of batteries which may be recharged or replaced by the operator.

7 Claims, 4 Drawing Sheets

BATTERY PACK FOR BATTERY OPERATED SPRAYER

BACKGROUND OF THE INVENTION

This invention relates to a battery operated trigger sprayer mountable on a container of product to be sprayed, and more particularly to a removable battery pack for the sprayer.

Typically, battery operated sprayers and dispensers provide for some type of access to a battery compartment for the removal, replacement and/or recharging of the batteries. For example, the housing of a power drive unit is removed from the fluid dispenser in the U.S. Pat. No. 5,716,007. Or, a top battery cover in U.S. Pat. No. 5,397,034 is slid open to access the batteries.

When replaceable batteries are used, at least two and normally four of such batteries are individually clamped in place within the sprayer, or a rechargeable battery or accumulator is individually clamped in place. Thus, when the batteries need replaced or recharged in use, as during garden spraying, the operator must remove them one-at-a-time taking care not to drop them or lose them in the garden, and eventually install fresh batteries.

The need arises to provide for a removable battery pack which supports the batteries so as to be removed together as one unit thereby avoiding the time-consuming and cumbersome single battery handling as before. It would improve upon the convenience in use if the batteries could be removed and replaced with one hand while holding the sprayer with the other.

SUMMARY OF THE INVENTION

It is therefore an object of the present invention to provide a battery operated sprayer having a removable battery pack which wholly supports the batteries as a unit when removed.

The battery pack according to the invention comprises a holder for removably supporting the batteries as a unit, the holder itself being removably supported within the sprayer for easy access. In one embodiment the holder forms an access panel which fits within a cutout provided within a handle grip portion of the sprayer, the handle grip being solely grasped by the operator for operation of the trigger actuator and for supporting the container to which the sprayer is attached. The cutout may be formed in the front and adjoining side walls of the handle for convenience in gaining access to the battery pack with its access panel contoured to fit which within the general outline of the handle.

In accordance with another embodiment, the battery pack holder is removably mounted within an upper portion of the sprayer, the access panel comprising a hinged cover. The holder may be mounted to the sprayer body or to an underside of the hinged cover for easy access.

It is a further objective of the invention to provide such a removable battery pack which is easily accessible for simple and quick installation and removable and which is of simple and economical construction yet highly efficient in therefore keeping the overall parts of the sprayer attractively low.

Other objects, advantages, and novel features of the invention will become more apparent from the following detailed description of the invention when taken in conjunction with the accompanying drawings.

DETAILED DESCRIPTION OF THE INVENTION

Figure 2:
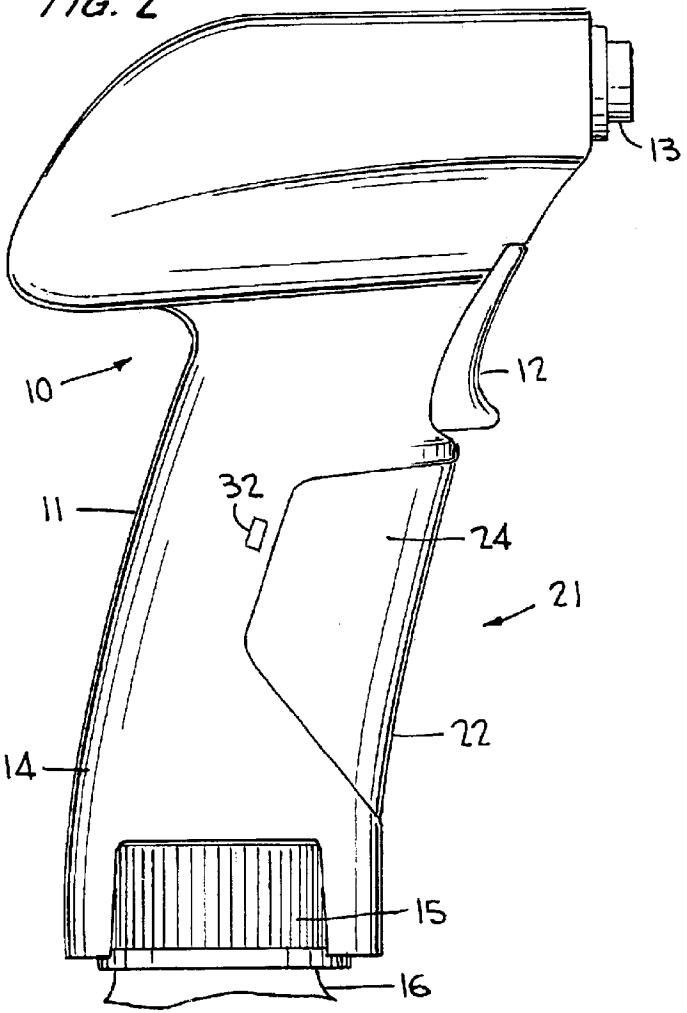
FIG. 2 a view similar to FIG. 1 showing the battery pack fully installed within a cutout of the handle.
Figure 1:
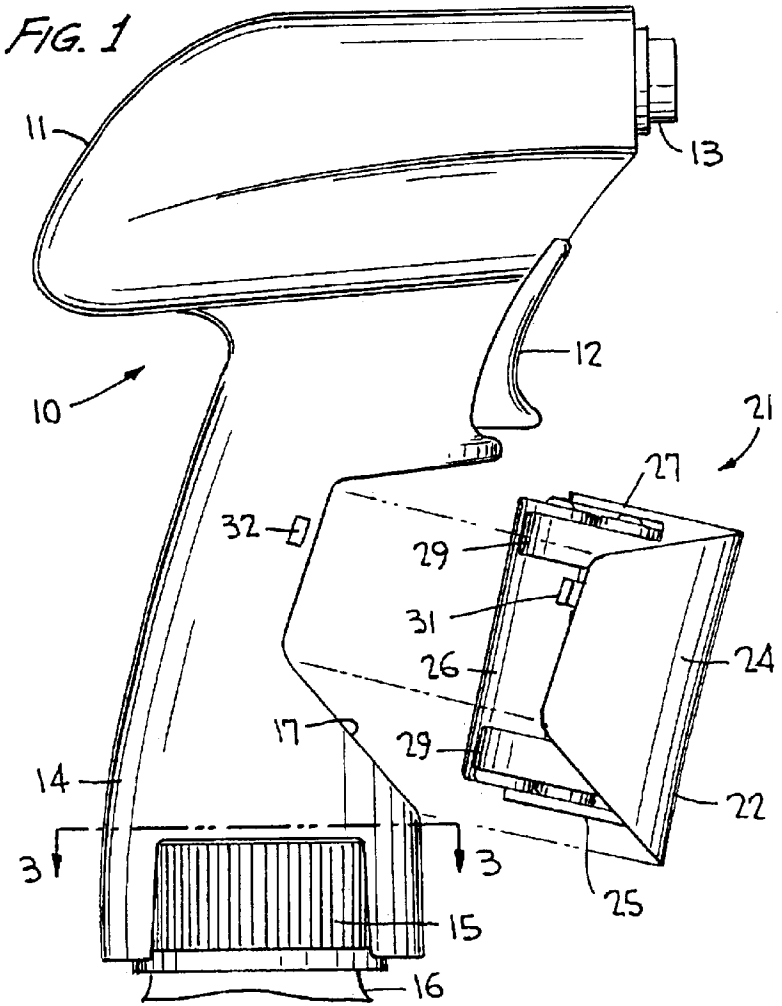
FIG. 1 is a side elevational view of a battery operated trigger sprayer according to one embodiment of the invention shown mounted to a container and incorporating the battery pack according to the invention shown in the process of removal or reinstallation.

Turning now to the drawings wherein like reference characters refer to like and corresponding parts throughout the several views, the battery operated trigger sprayer which incorporates one embodiment of the invention is generally designated 10 in FIGS. 1 and 2 and comprises a sprayer body 11 which covers a pump assembly which includes a variable volume pump chamber (not shown) into which an inlet passage 20 extends from an inlet tube which extends into the bottle, as typically shown in application Ser. No. 10/208,008, commonly-owned herewith, and specifically incorporated herein by reference. A drive motor (not shown) is operated upon actuation of a trigger lever 12 which facilitates manual opening and closing of a switch (not shown) to operate the drive motor by a gearing and cams arrangement similar to that disclosed in U.S. Pat. No. 5,716,007, the entirety of which is specifically enclosed incorporated herein by reference. Other pump assembles may be provided such as those including a self-priming rotary pump, a diaphragm pump, or a piston/cylinder pump, within the purview of the invention.

A discharge nozzle 13 is located at the front end of the sprayer through which liquid product is discharged in the form of a spray or stream upon trigger lever actuation as in a manner well known in this art.

The sprayer body includes a handle portion 14 which is solely gripped by the operator, without gripping any neck portion of the container 16, for both supporting container 16 to which the sprayer is coupled as well as for operating the sprayer upon squeezing the trigger lever 12. The handle portion comprises a sufficiently long neck providing the sole means for gripping by the operator to both support the container and to operate the sprayer.

A container closure 15 is coupled to handle portion 14 at its free end in some suitable manner for rotation about the central axis of the closure to facilitate the mounting of the sprayer to container 16 of product to be sprayed. The container includes a neck having external threads (not shown) which cooperate in the usual manner with the internal threads of closure 15 to facilitate removable securement of the sprayer to the container.

Figure 4:
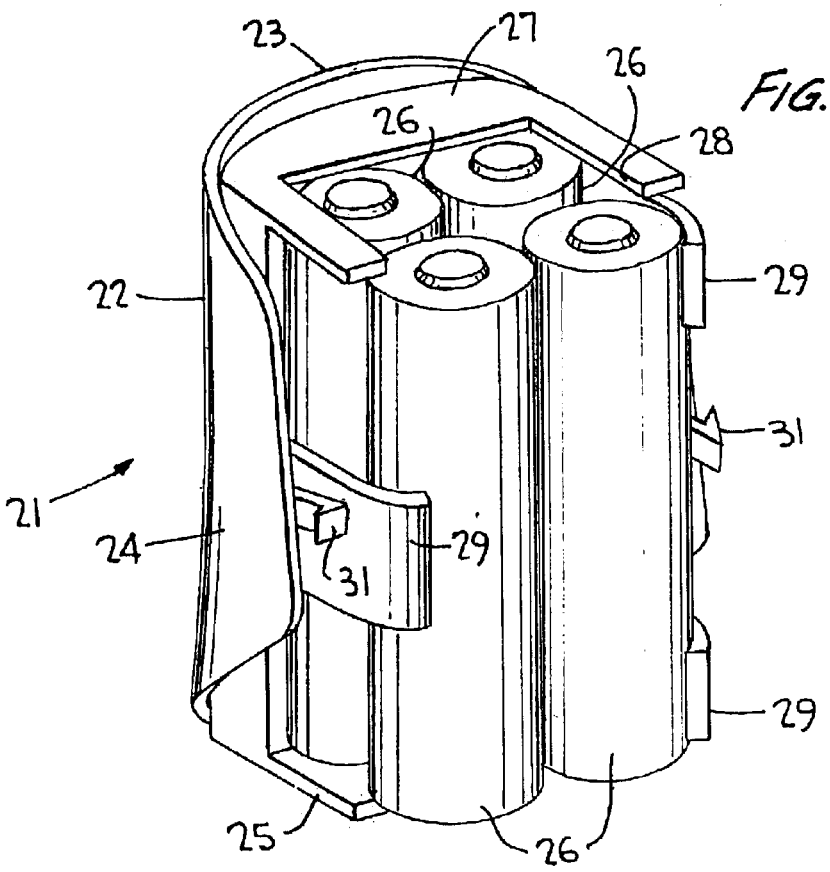
FIG. 4 is an enlarged perspective view of the battery pack according to the invention which supports a plurality of batteries as a unit.
Figure 5:
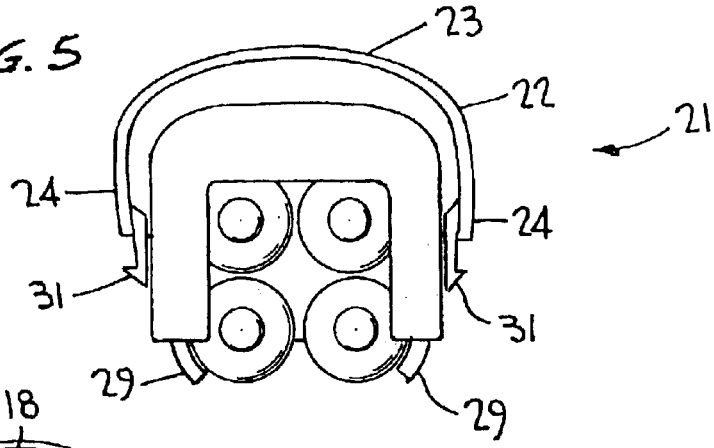
FIG. 5 is a top plan view of the FIG. 4 battery pack at a reduced scale.
Figure 3:
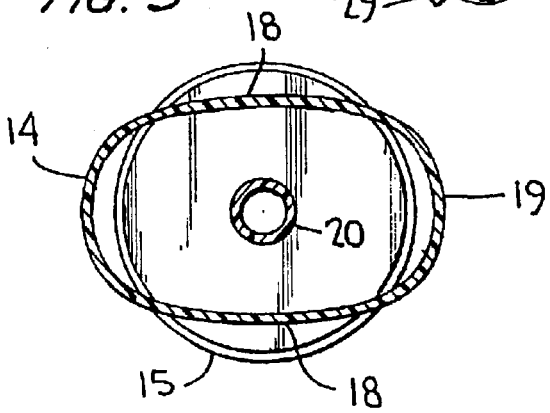
FIG. 3 is a sectional view taken substantially along the line 3—3 of FIG. 1.

In the embodiment of FIGS. 1 to 5, handle portion 14 has an opening in the form of a cutout 17 which includes opposing side walls 18 and front wall 19 thereof. The cutout is of a predetermined size and contour and may be of an irregular shape such as essentially trapezoidal as shown. A removable battery pack generally designated 21 in FIGS. 4 and 5 is inserted into handle portion 14 at cutout 17 such that when fully assembled as in FIG. 2, the battery pack forms part of the gripping portion of the handle.

As more clearly detailed in FIGS. 4 and 5, battery pack 21 comprises a battery holder 22 having a front wall or panel 23 which is of the same general shape as front wall 19 of the handle, and has opposing side walls 24 of generally the same size and contour as that formed by cutout 17 along the opposing sides of the handle. It can therefore be seen that battery holder 22 is complementary in shape and size to that of cutout 17 so as to fit snugly within the cutout when assembled to the sprayer to form a smooth extension of the opposing side walls and the front wall thereof.

The battery holder has a lower support wall 25 underlying an array of upstanding batteries 26 which may be of the standard household variety.

The holder further has an upper wall 27 which partially overlies the upper ends of the batteries and which has an opening 28 of sufficient size to expose the battery ends to the wire connectors or to a metallic contact plate (neither shown) or the like mounted within handle 14 at the upper end of its cutout 17.

Extending outwardly of both side walls 24 of the battery holder are resilient arms 29 embracing the outer pair of batteries to snugly retain all the batteries within holder 22 to avoid dislodgement of the batteries from the holder as when breaking contact with the wire connectors or the metal contact plate during removal of the battery pack from the sprayer handle portion 14. Additionally, the battery holder has a pair of spring biased latches 31 with cammed ends provided to slide along the inner surfaces of the side walls 18 of the handle until they project outwardly through openings 32 adjacent the handle cutout as shown in FIGS. 1 and 2. As known for these type latches, the latch ends simply extend partially through openings 32 when in the fully assembled position of FIG. 2 and, when it is desired to remove the battery holder from the handle portion, the latch ends are simply depressed inwardly by the operator until they clear openings 32 allowing the holder to be removed.

When assembled to the handle to form a part thereof, as shown in FIG. 2, the battery pack forms a part of the handle itself and is gripped by the operator for both supporting the liquid container during use and for operating the sprayer upon actuation of trigger lever 12. Depression of the trigger lever simply facilitates contact of a switch plate with the battery wires or contact plate for completing the battery circuit to the motor to operate the motor which turns the gears to operate the pump for pumping liquid product which is drawn up through inlet passage 20 into the pump chamber and out through the discharge passage and nozzle opening in a manner well known in this art. Battery holder 22 is structured such that the batteries are securely supported therein in horizontal alignment and are not likely to dislodge on removal of the battery pack from the sprayer as the batteries break connection with the wire connectors or contact plate within the sprayer handle portion. The batteries can be removed and simply replaced within holder 22 and the battery pack reassembled back to its FIG. 2 position at which it is snapped in place by snap latches 31 cooperating with openings 32.

In lieu of standard household batteries, a rechargeable battery or batteries can be provided in holder 22 for recharging in some normal manner.

In accordance with another embodiment of the invention shown in FIGS. 6 to 9, the battery operated sprayer is generally designated 33 having a sprayer body 34 of similar design to that of battery operated sprayer 10 except that handle portion 35 can have a shorter length compared to handle portion 14 thereby reducing the overall height of the sprayer from the top of container 16. A pump assembly 36 which may be of the variable volume type is housed within handle portion 35 as is a drive motor 37 of some type.

Figure 9:
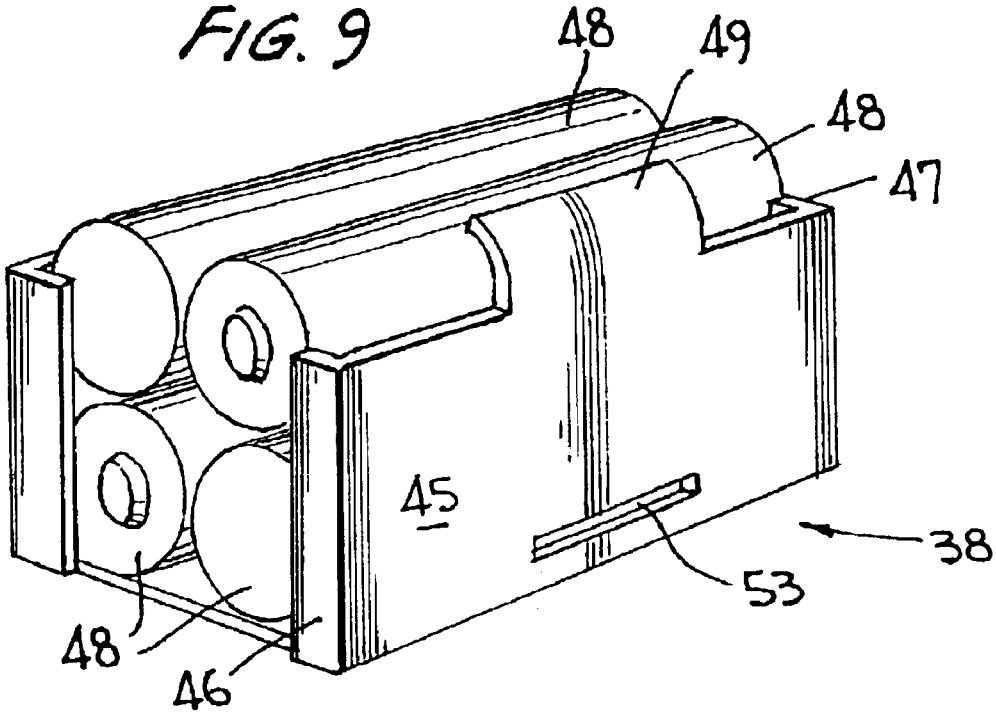
FIG. 9 is a perspective view of the battery pack of FIG. 6.

A battery pack shown in detail in FIG. 9 is generally designated 38 and is removably mounted within an upper portion of the sprayer and made accessible via a movable panel forming a wall of the sprayer body. In the sprayer 33 embodiment, the movable panel may be in the form of a cover 39 hinged to the sprayer body in some convenient manner as by a live hinged 41 or the like. The cover acts as a battery door having a top wall 42 and side walls 43, 44 surrounding and covering battery pack 38 as shown in FIGS. 6 and 7.

The battery pack includes a holder 45 having opposing end walls 46, 47 with openings sized to expose the battery poles for contact engagement in some suitable manner with a battery wire lead connected to the drive motor. Holder 45 forms a cradle for storing batteries 48 which are shown as 4 in number stacked with one pair atop the other. However, the batteries can otherwise be arranged within the holder such that the upper pair would be in tandem to the lower pair with all four batteries lying in a single plan. Irrespective of the cluster arrangement to the batteries, they are removably secured within the holder by the provision of spring arms 49.

Figure 6:
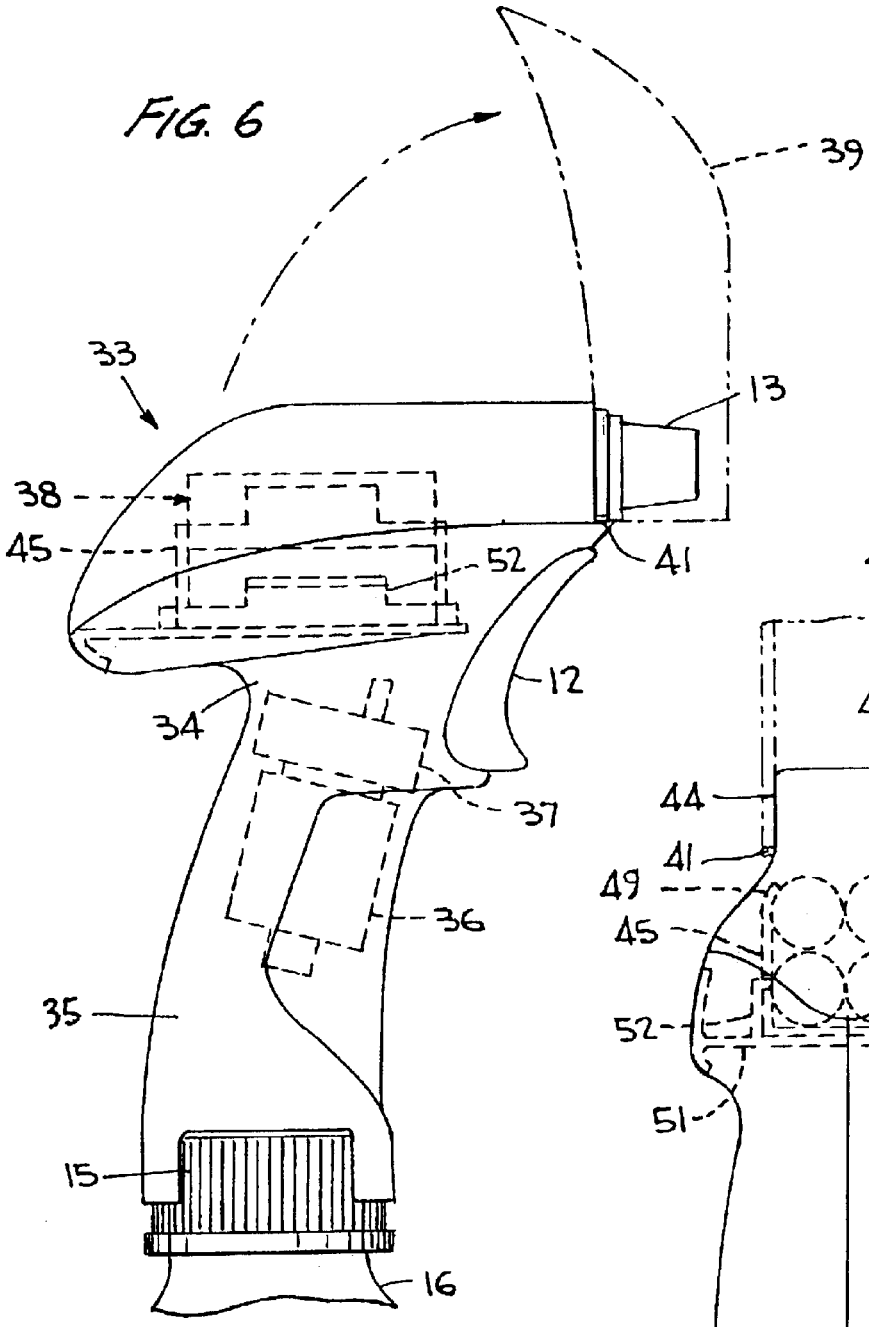
FIG. 6 is similar to FIG. 1 of another embodiment of the invention showing the battery pack mounted within an upper portion of the sprayer.
Figure 7:
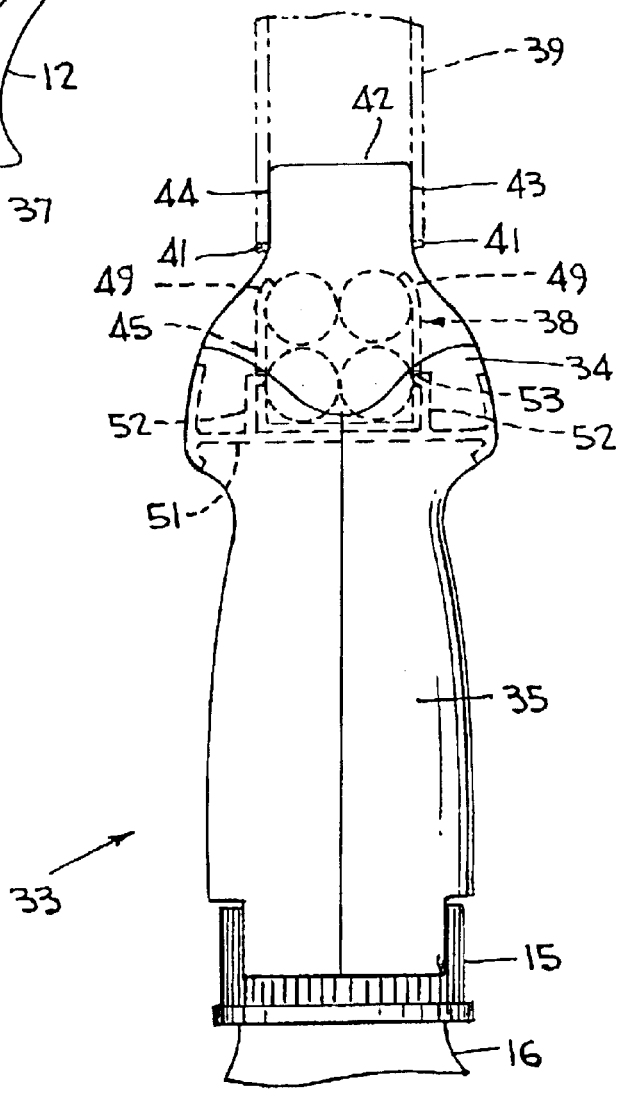
FIG. 7 is a rear elevational view of the FIG. 6 sprayer.

As most clearly shown in FIGS. 6 and 7, battery holder 45 is mounted within the pump body on some suitable support plate 51 or the like which may have upstanding spring arms 52 (FIG. 7) which may have ribs or detents engaging retention grooves 53 (FIG. 9) or the like for removably retaining the holder in place.

Thus, when it comes time to replace the batteries which have lost their charge which may occur while using the sprayer, for example, in garden spray, the battery lid or cover, which may be spring-snapped closed in some manner, is hinged open in the direction of the curved arrow of FIG. 6 rendering the battery pack fully accessible for removal of the batteries as a pack, together with their holder 45. In such manner the sprayer can simply be held with one hand while the battery pack is removed with the other without fumbling with a plurality of single batteries in the garden thereby adding to the frustration and convenience. The batteries may thereafter be individually removed from their battery pack and replaced with the fresh battery pack reinstalled.

Figure 8:
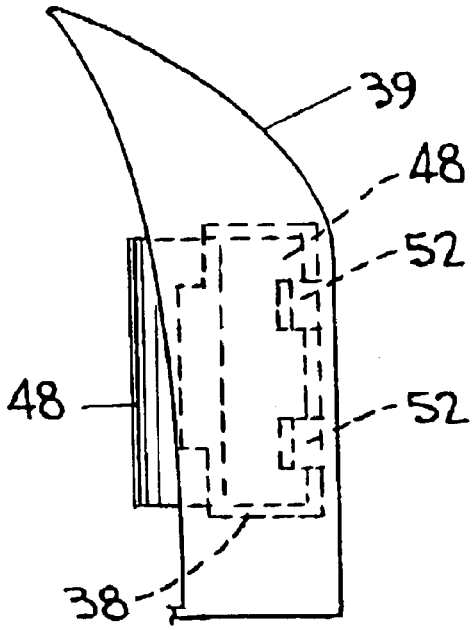
FIG. 8 is a side elevational view of the hinged cover of FIG. 6 showing the battery pack removably mounted to the underside of the cover.

The battery pack may otherwise be mounted to the underside of cover 39 as shown in FIG. 8 for removal by spring arms 22 in a similar manner as described with reference to FIGS. 6, 7. Thus, upon swinging the battery cover to its open position as shown in phantom outline in FIG. 6, the battery is now supported within the cover itself and can be simply accessed easily for removal as a pack as in the same manner described with reference to FIGS. 6, 7.

From the foregoing it can be seen that a simple and efficient yet highly effective battery pack is devised for a battery operated sprayer which is made readily accessible by a movable panel forming a handle grip wall or top wall of the sprayer body. The battery pack comprises a battery holder which is removable as a unit via the access panel which may be attached to the holder forming part of the handle grip, or which may be removably mounted within a top portion of the sprayer beneath a hinged battery cover or to the battery cover itself. Removal of the battery pack from the sprayer handle and replacement of the batteries is thereby rendered quick and easy and uncomplicated, and the battery pack with fresh batteries can then be reassembled to the sprayer handle with little down time.

Obviously, many modifications and variations of the present invention are made possible in the light of the above teachings. It is therefore to be understood that within the scope of the appended claims the invention may be practiced otherwise than as specifically described.

What is claimed is:

1. A battery operated pump sprayer comprising a sprayer body which includes a trigger actuator and a spray nozzle, container closure means coupled to said body for mounting the sprayer to a container of liquid to be sprayed by the nozzle on actuation of the trigger, the sprayer body having a handle portion of a predetermined length as to be soley grasped by the operator while activating the trigger actuator and for holding the container during operation, the closure means being mounted at a free end of the handle, and a removable battery pack mounted within the sprayer body, the battery pack comprising a movable panel forming a wall of the sprayer body, the movable panel having a holder supporting at least one battery which may be recharged or replaced by the operator.

2. The sprayer according to claim 1, wherein the battery pack is located within the handle portion of the sprayer body, the panel being removable and comprising a portion of the handle which is grasped by the operator, and the holder being fixedly mounted to the panel.

3. The sprayer according to claim 2, wherein the panel comprises the portion of a front wall of the handle.

4. The sprayer according to claim 2, wherein cooperating snap-fit fastening means acting between the panel and a confronting portion of the handle are provided for retaining the panel in place.

5. The sprayer according to claim 1, wherein means on the holder are provided for removably retaining the battery in place.

6. A battery operated sprayer comprising a sprayer body which includes a trigger actuator and a spray nozzle, container closure means coupled to said body for mounting the sprayer to a container of liquid to be sprayed by the nozzle on actuation of the trigger, the sprayer body having an upper portion aligned with the nozzle and having a handle portion lying substantially perpendicular to the upper portion, the handle portion having a predetermined length as to be solely grasped by the operator while activating the trigger actuator and for holding the container during operation, the closure means being mounted on a free end of the handle, and a removable battery pack mounted within the upper portion of the sprayer body, the battery pack comprising a holder supporting at least one battery which may be recharged or replaced by the operator, the sprayer body having a support for removably retaining the holder in place, and a cover hingedly connected to the sprayer body for movement between a closed position covering the battery pack and an open position to provide access to the battery pack, the cover forming a top wall of the sprayer body.

7. A battery operated sprayer comprising a sprayer body which includes a trigger actuator and a spray nozzle, container closure means coupled to said body for mounting the sprayer to a container of liquid to be sprayed by the nozzle on actuation of the trigger, the sprayer body having an upper portion aligned with the nozzle and having a handle portion lying substantially perpendicular to the upper portion, the handle portion having a predetermined length as to be solely grasped by the operator while activating the trigger actuator and for holding the container during operation, the closure means being mounted on a free end of the handle, and a removable battery pack mounted within the upper portion of the sprayer body, the battery pack comprising a holder supporting at least one battery which may be recharged or replaced by the operator, the battery pack further comprising a cover hingedly connected to the sprayer body for movement between a closed position forming a top wall of the sprayer body and an open position to provide access to the battery pack, the holder supporting at least one battery being removably mounted to an underside of the cover.

* * * * *